US010386075B2

(12) United States Patent
Cadima

(10) Patent No.: US 10,386,075 B2
(45) Date of Patent: Aug. 20, 2019

(54) COOKTOP APPLIANCE WITH A GAS BURNER ASSEMBLY

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/648,545

(22) Filed: Jul. 13, 2017

(65) Prior Publication Data

US 2019/0017710 A1 Jan. 17, 2019

(51) Int. Cl.

| | |
|---|---|
| ***F24C 3/12*** | (2006.01) |
| ***F24C 3/08*** | (2006.01) |
| ***F23D 14/72*** | (2006.01) |
| ***F23N 5/02*** | (2006.01) |
| ***F23D 14/06*** | (2006.01) |

(52) U.S. Cl.

CPC ..... *F24C 3/124* (2013.01); *F23D 14/065* (2013.01); *F23D 14/725* (2013.01); *F23N 5/02* (2013.01); *F24C 3/082* (2013.01); *F24C 3/085* (2013.01); *F24C 3/126* (2013.01)

(58) Field of Classification Search

CPC .... F24C 3/10; F24C 3/08; F24C 3/082; F24C 3/085; F24C 3/103

USPC ..... 126/39 E, 39 H, 39 R; 431/354, 284

See application file for complete search history.

(56) References Cited

U.S. PATENT DOCUMENTS

| | | | | |
|---|---|---|---|---|
| 6,322,354 | B1 | 11/2001 | Carbone et al. | |
| 6,663,009 | B1 * | 12/2003 | Bedetti | F24C 3/126 126/374.1 |
| 8,479,721 | B2 | 7/2013 | Graham et al. | |
| 8,845,326 | B2 | 9/2014 | Shaffer et al. | |
| 8,973,569 | B2 * | 3/2015 | Padgett | F23D 14/06 126/39 E |
| 2004/0048216 | A1 | 3/2004 | Brown et al. | |
| 2012/0152230 | A1 * | 6/2012 | Armanni | F23D 14/065 126/39 E |
| 2014/0048293 | A1 | 2/2014 | Luongo et al. | |
| 2014/0090636 | A1 * | 4/2014 | Bettinzoli | F23D 14/06 126/39 E |
| 2014/0295357 | A1 | 10/2014 | McAfee et al. | |

(Continued)

FOREIGN PATENT DOCUMENTS

| | | | |
|---|---|---|---|
| CN | 1594975 | B | 4/2010 |
| EP | 0887590 | A1 | 12/1998 |
| JP | 3737184 | B2 | 1/2006 |

(Continued)

*Primary Examiner* — Avinash A Savani
*Assistant Examiner* — Rabeeul I Zuberi
(74) *Attorney, Agent, or Firm* — Dority & Manning, P.A.

(57) ABSTRACT

A cooktop appliance includes a gas burner assembly with an annular burner body that defines a central combustion zone. Gaseous fuel is flowable from a fuel chamber within the annular burner body into the central combustion zone through a plurality of flame ports. A temperature probe is spring loaded away from a top surface of a top panel such that a distal end of the temperature probe is normally positioned above the annular burner body. The cooktop appliance also includes features for limiting or preventing flame impingement against the temperature probe.

11 Claims, 7 Drawing Sheets

(56) References Cited

U.S. PATENT DOCUMENTS

2016/0209044 A1* 7/2016 Cadima ..... F24C 3/126

FOREIGN PATENT DOCUMENTS

JP 2007057226 A 3/2007
JP 04595599 B2 12/2010

* cited by examiner

COOKTOP APPLIANCE WITH A GAS BURNER ASSEMBLY

FIELD OF THE INVENTION

The present subject matter relates generally to cooktop appliances with gas burner assemblies, such as gas range appliances or gas stove appliances.

BACKGROUND OF THE INVENTION

Gas cooktop appliances generally include a plurality of gas burners mounted at a top surface of the appliance. Certain gas cooktop appliances include gas burners with spring loaded temperature sensors. When cooking utensils are positioned on a grate above such gas burners, the spring loaded temperature sensor contacts the cooking utensil and measures a temperature of the cooking utensil. The gas burner deactivates if temperature measurements from the spring loaded temperature sensor exceed a maximum temperature. Thus, if a pot boils dry, the spring loaded temperature sensor prevents the gas burner from heating the pot to an undesirable temperature.

Gas burners that fire inwards, typically with a swirling flame pattern, offer better efficiency than traditional outward firing gas burners. One problem with known inward firing gas burners is that a center of the inward firing gas burners is open, and a portion of the top panel below the open center is perforated to allow components of the inward firing gas burners to pass through the top panel, but spills can also pass through the perforated top panel. Such spills can be difficult to clean. In addition, incorporating a centrally located spring loaded temperature sensor into an inward firing gas burner can be difficult due to excessive flame impingement against the spring loaded temperature sensor.

Accordingly, an inward firing gas burner with a temperature sensor that is not excessively heated would be useful.

BRIEF DESCRIPTION OF THE INVENTION

The present subject matter provides a cooktop appliance with a gas burner assembly. The gas burner assembly includes an annular burner body that defines a central combustion zone. Gaseous fuel is flowable from a fuel chamber within the annular burner body into the central combustion zone through a plurality of flame ports. A temperature probe is spring loaded away from a top surface of a top panel such that a distal end of the temperature probe is normally positioned above the annular burner body. The cooktop appliance also includes features for limiting or preventing flame impingement against the temperature probe. Additional aspects and advantages of the invention will be set forth in part in the following description, or may be apparent from the description, or may be learned through practice of the invention.

In a first example embodiment, a cooktop appliance is provided. The cooktop appliance includes a top panel. A gas burner assembly is positioned at the top panel. The gas burner assembly includes an annular burner body positioned on the top panel at a top surface of the top panel. The annular burner body defines a central combustion zone. The annular burner body also defines a plurality of flame ports at the central combustion zone. Gaseous fuel is flowable from a fuel chamber within the annular burner body into the central combustion zone through the plurality of flame ports. A temperature probe is positioned adjacent an outer circumference of the annular burner body. The temperature probe is spring loaded away from the top surface of the top panel such that a distal end of the temperature probe is normally positioned above the annular burner body.

In a second example embodiment, a cooktop appliance is provided. The cooktop appliance includes a top panel. A gas burner assembly is positioned at the top panel. The gas burner assembly includes an annular burner body that is positioned on the top panel at a top surface of the top panel. The annular burner body defines a central combustion zone. The annular burner body also defines a plurality of flame ports at the central combustion zone. Gaseous fuel is flowable from a fuel chamber within the annular burner body into the central combustion zone through the plurality of flame ports. A temperature probe is positioned adjacent an inner circumference of the annular burner body. The temperature probe is spring loaded away from the top surface of the top panel such that a distal end of the temperature probe is normally positioned above the annular burner body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
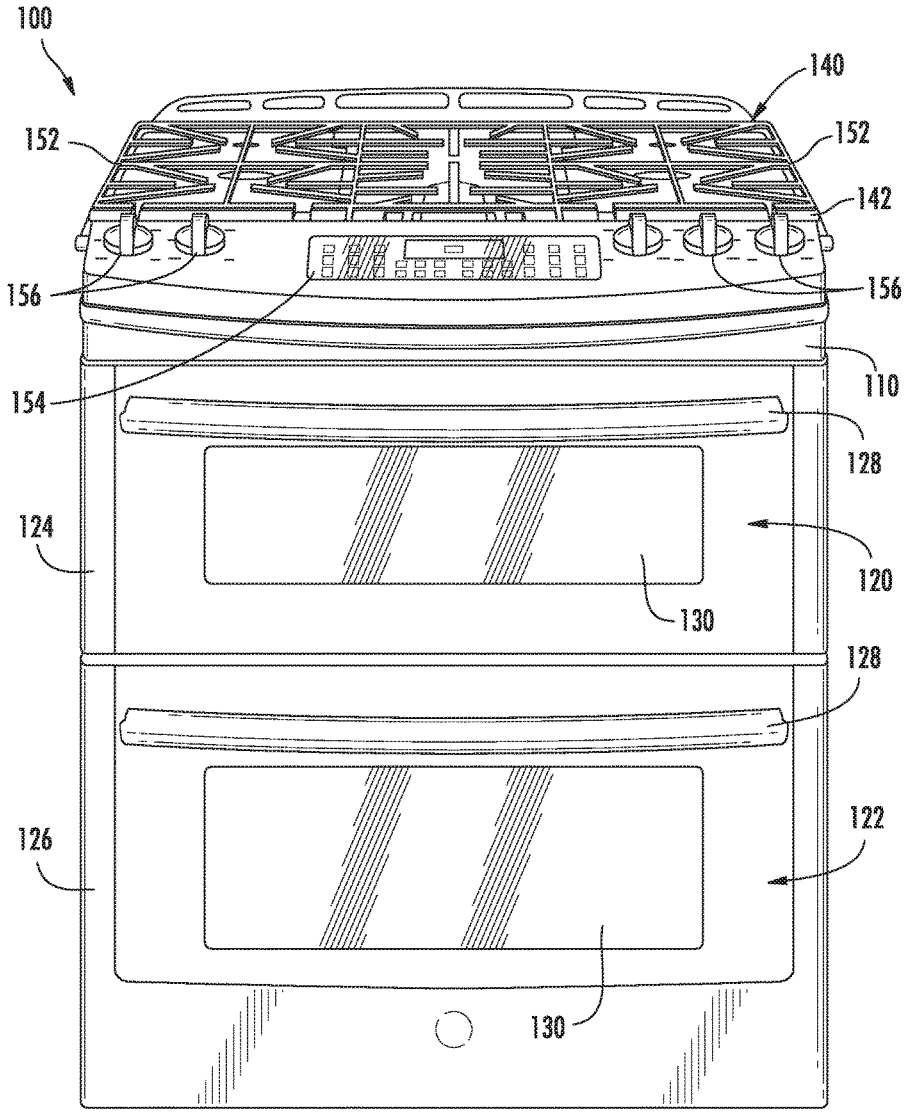
FIG. 1 is a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
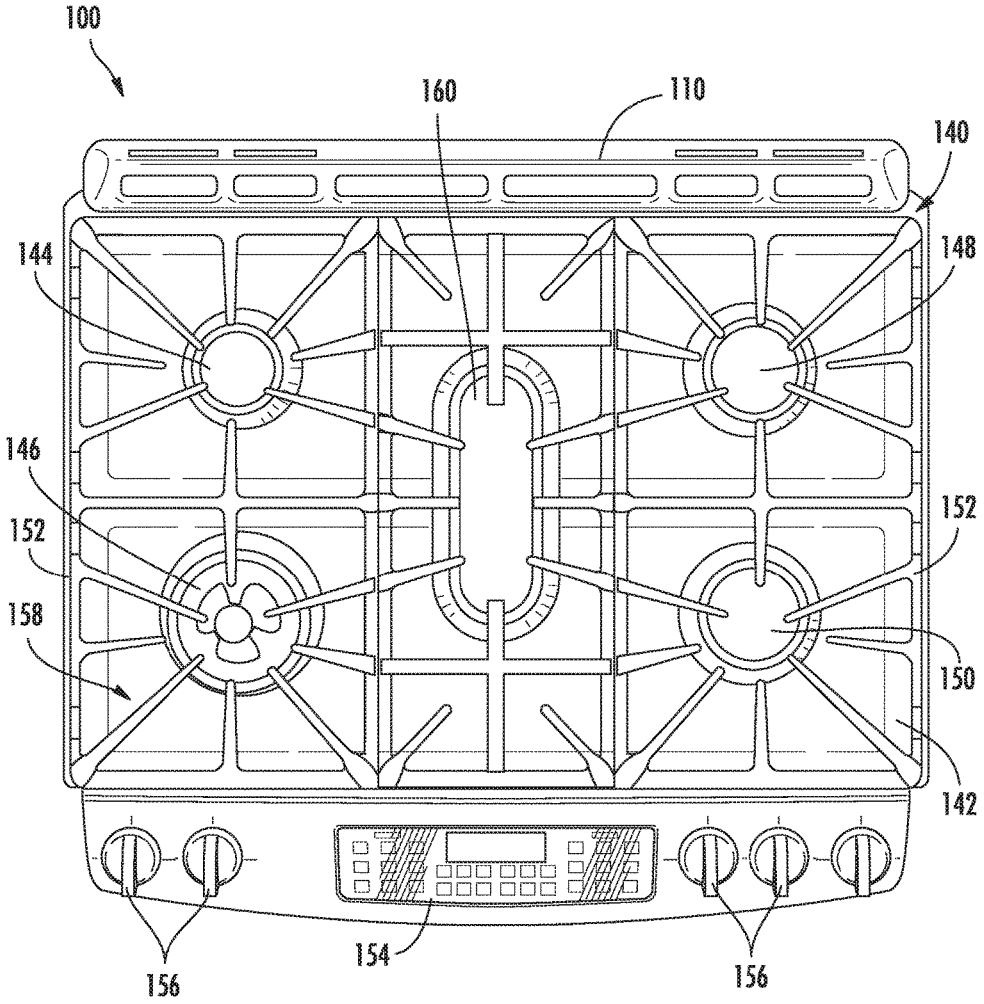
FIG. 2 is a top, plan view of the exemplary range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
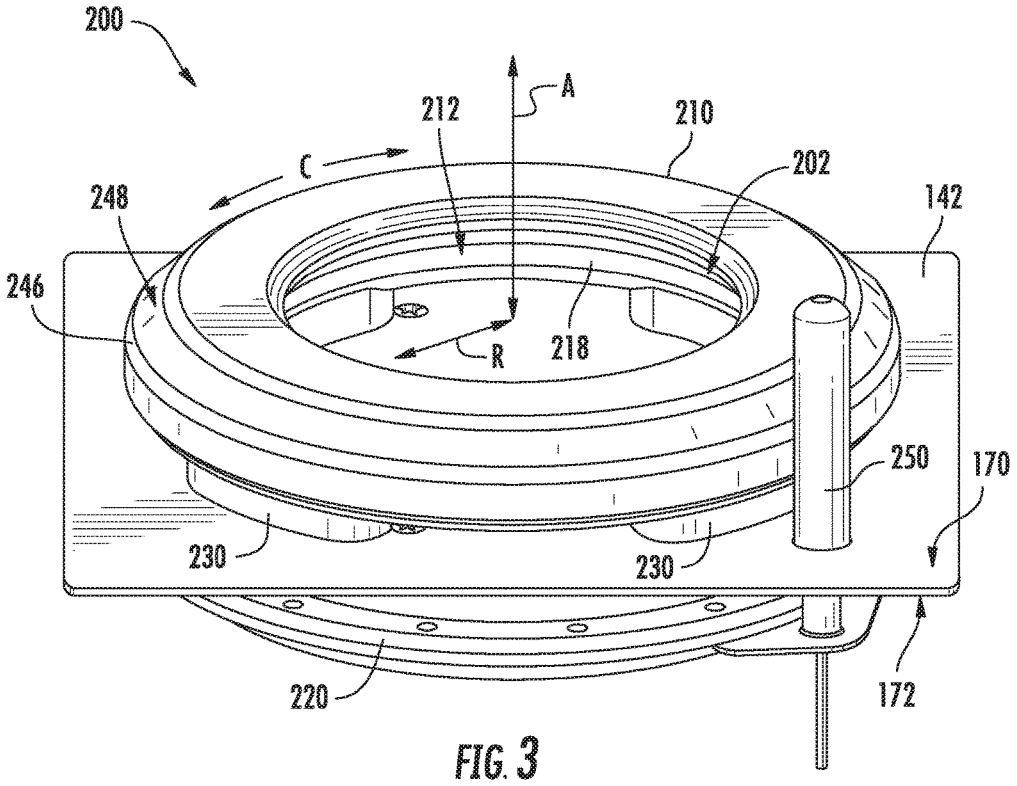
FIG. 3 is a perspective view of a gas burner assembly according to an example embodiment of the present subject matter.
Figure 4:
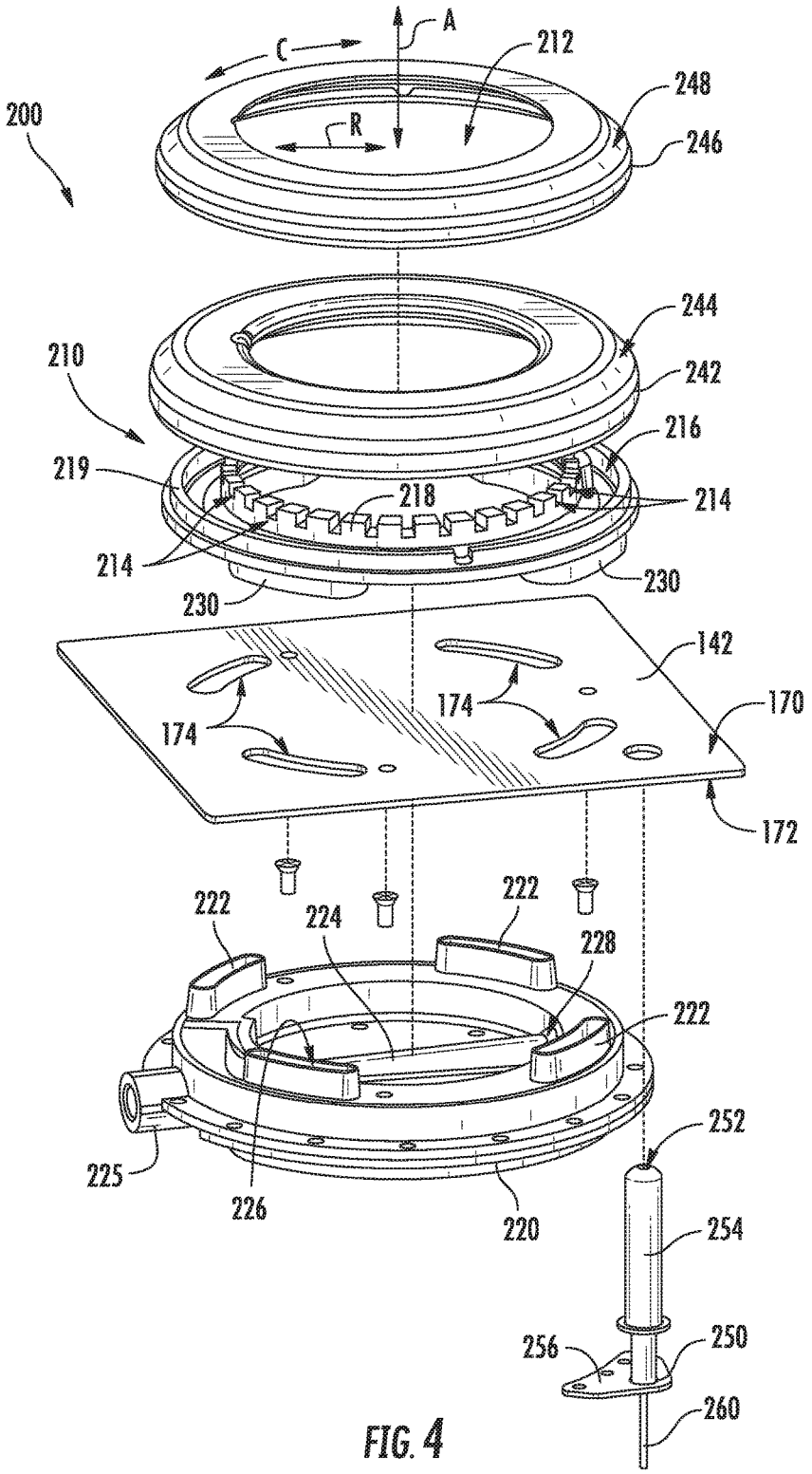
FIG. 4 is an exploded view of the example gas burner assembly of FIG. 3.
Figure 5:
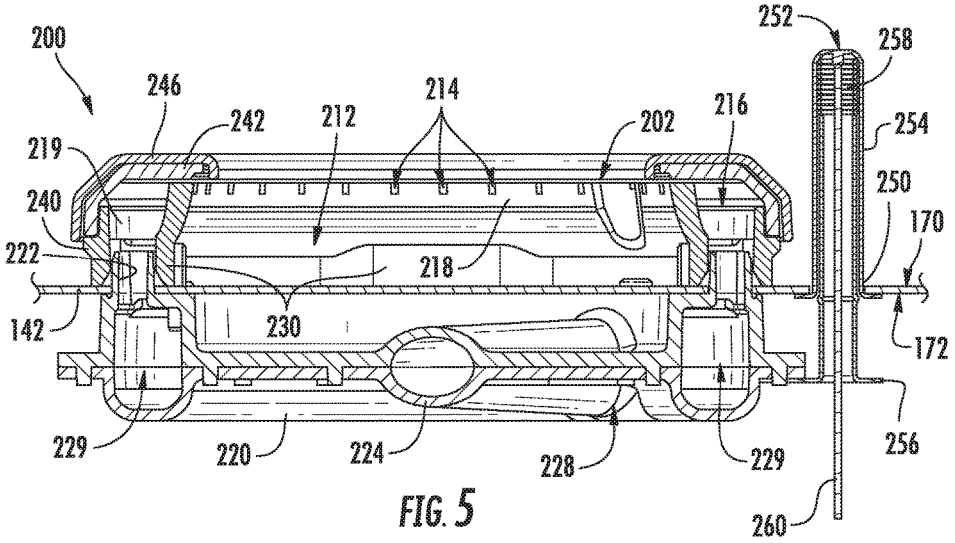
FIG. 5 is a section view of the example gas burner assembly of FIG. 3.

FIG. 3 is a perspective view of a gas burner assembly 200 according to an example embodiment of the present subject matter. FIG. 4 is an exploded view of gas burner assembly 200, and FIG. 5 is a section view of gas burner assembly 200. As an example, burner assembly 200 may be used in range appliance 100 (FIG. 2) as one of burner assemblies 144, 146, 148, 150. However, it will be understood that, while describe in greater detail below in the context of range appliance 100, burner assembly 200 may be used in or with any suitable appliance in alternative exemplary embodiments. As may be seen in FIG. 3, burner assembly 200 includes an inner burner ring 202. Inner burner ring 202 may be inward firing with a swirling flame pattern. Burner assembly 200 defines an axial direction A, a radial direction R and a circumferential direction C.

In FIG. 3, burner assembly 200 is positioned at top panel 142. As shown in FIGS. 3 through 5, burner assembly 200 includes an annular burner body 210. Annular burner body 210 is positioned on top panel 142 at a top surface 170 of top panel 142. For example, annular burner body 210 may rest one top panel 142 at top surface 170 of top panel 142 such that annular burner body 210 is not fastened or otherwise mechanically fixed to top panel 142. Thus, a user may simply lift annular burner body 210 upwardly away from top panel 142 to remove annular burner body 210 from top panel 142.

Annular burner body 210 defines a central combustion zone 212. Annular burner body 210 also defines a plurality of flame ports 214, e.g., at or facing central combustion zone 212. Flame ports 214 may be distributed, e.g., along the circumferential direction C, about central combustion zone 212. Gaseous fuel is flowable from a fuel chamber 216 within annular burner body 210 into central combustion zone 212 through flame ports 214. Flame ports 214 may also be oriented such that the gaseous fuel flows in a swirling pattern from flame ports 214 into central combustion zone 212. As may be seen in FIG. 4, annular burner body 210 may include an inner side wall 218 and an outer side wall 219. Inner side wall 218 may extend around central combustion zone 212, e.g., along the circumferential direction C. Flame ports 214 may be formed on or extend through inner side wall 218, e.g., along the radial direction R, between fuel chamber 216 and central combustion zone 212. Outer side wall 219 may extend around inner side wall 218, e.g., along the circumferential direction C. Outer side wall 219 may also be spaced from inner side wall 218, e.g., along the radial direction R. Fuel chamber 216 may be defined and positioned between inner and outer side walls 218, 219, e.g., along the radial direction R, within annular burner body 210.

Annular burner body 210 is open at central combustion zone 212. Thus, e.g., no portion or component of annular burner body 210 may extend, e.g., along the radial direction R, into central combustion zone 212. Top panel 142 may be exposed through annular burner body 210 at central combustion zone 212. In such a manner, spills from utensils above burner assembly 200 may flow through central combustion zone 212 to top panel 142, and such spills may pass through burner assembly 200 without contacting burner assembly 200 at central combustion zone 212. Staining of annular burner body 210 may be reduced or limited by allowing spills to pass through annular burner body 210 at central combustion zone 212.

Top panel 142 may also be continuous and/or imperforate directly below central combustion zone 212. Thus, spills passing through central combustion zone 212 may collect on top panel 142 and not flow through top panel 142. A user may easily access and clean such spills on top panel 142 by removing annular burner body 210 from top panel 142. In such a manner, burner assembly 200 may facilitate cleaning of spills from utensils positioned over burner assembly 200.

Burner assembly 200 also includes a fuel manifold 220. Fuel manifold 220 is mounted to top panel 142, e.g., with fasteners, at a bottom surface 172 of top panel 142. Thus, fuel manifold 220 may be positioned opposite annular burner body 210 on or about top panel 142. Annular burner body 210 is connectable to fuel manifold 220 such that the gaseous fuel is flowable from fuel manifold 220 into fuel chamber 216 of annular burner body 210. For example, fuel manifold 220 has a plurality of outlet passages 222. The gaseous fuel is flowable from fuel manifold 220 through outlet passages 222 into fuel chamber 216 of annular burner body 210.

Fuel manifold 220 has a horizontal Venturi mixing tube 224. Horizontal Venturi mixing tube 224 has an inlet 226 and an outlet 228. Inlet 226 of horizontal Venturi mixing tube 224 may be positioned at one side portion of fuel manifold 220, and outlet 228 of horizontal Venturi mixing tube 224 may be positioned at an opposite side portion of fuel manifold 220. Thus, horizontal Venturi mixing tube 224 may extend across fuel manifold 220, e.g., along the radial direction R, and inlet and outlet 226, 228 of horizontal Venturi mixing tube 224 may be positioned opposite each other on fuel manifold 220.

A fuel nozzle (not shown) may be positioned at and oriented towards inlet 226 of horizontal Venturi mixing tube 224. In particular, the fuel nozzle may be mounted to a fuel nozzle bracket 225, e.g., such that the fuel nozzle is spaced from inlet 226 of horizontal Venturi mixing tube 224, e.g., along the radial direction R. The fuel nozzle may be connected to a supply line for gaseous fuel, such as propane or natural gas, and the gaseous fuel may flow from the fuel nozzle to inlet 226 of horizontal Venturi mixing tube 224. Between the fuel nozzle and inlet 226 of horizontal Venturi mixing tube 224, the gaseous fuel may entrain air, and the gaseous fuel may mix with the entrained air within horizontal Venturi mixing tube 224. The mixture of the gaseous fuel and air may exit horizontal Venturi mixing tube 224 at outlet 228 of horizontal Venturi mixing tube 224 and flow into an annular mixing chamber 229 within fuel manifold 220. Annular mixing chamber 229 is in fluid communication with outlet passages 222 such that the mixture of the gaseous fuel and air may flow from annular mixing chamber 229 into outlet passages 222. Thus, outlet passages 222 may extend upwardly, e.g., along the axial direction A, from annular mixing chamber 229.

Outlet passages 222 may extend through top panel 142, e.g., along the axial direction A, from fuel manifold 220 towards annular burner body 210. In particular, top panel 142 defines a plurality of openings 174. Each outlet passage 222 is received within and extends through a respective one of openings 174 of top panel 142. Thus, each opening 174 of top panel 142 is aligned with a respective outlet passage 222. Each opening 174 of top panel 142 may also be sized complementary with the respective outlet passage 222. Such sizing of openings 174 and outlet passages 222 may reduce leakage of spills through top panel 142.

Burner assembly 200 also includes a plurality of inlet passages 230. Inlet passages 230 extend downwardly, e.g., along the axial direction A, from annular burner body 210 towards top panel 142. As shown in FIG. 5, each inlet passage 230 may engage, e.g., be received on and/or over, a respective outlet passage 222. Thus, the gaseous fuel is flowable from outlet passages 222 of fuel manifold 220 into fuel chamber 216 of annular burner body 210 through inlet passages 230. Outlet passages 222 and inlet passages 230 may form flow paths for the gaseous fuel between fuel manifold 220 and annular burner body 210.

As shown in FIGS. 3 and 5, annular burner body 210 may also be suspended over top panel 142 on inlet passages 230. In particular, inlet passages 230 may extend, e.g., along the axial direction A, from annular burner body 210 to top panel 142 such that ends of inlet passages 230 rest on top panel 142 and annular burner body 210 is spaced from top panel 142, e.g., along the axial direction A. With annular burner body 210 suspended over top panel 142, secondary combustion air is flowable under annular burner body 210, e.g., along the radial direction R, into central combustion zone 212. The secondary combustion air can facilitate clean and efficient combustion of the gaseous fuel from flame ports 214 within central combustion zone 212.

Annular burner body 210 may include an annular burner base 240 and an annular burner head 242. Annular burner base 240 includes inlet passages 230 and may be positioned on or over top panel 142. Annular burner head 242 may be positioned on annular burner base 240 to form fuel chamber 216 of annular burner body 210. Thus, e.g., annular burner base 240 may form a bottom wall of fuel chamber 216, and annular burner head 242 may form a top wall of fuel chamber 216. Annular burner base 240 and/or annular burner head 242 may be formed of or with bronze or a cast metal, such as cast iron or cast aluminum.

Annular burner body 210 may also include an annular burner cap 246. Annular burner cap 246 may be positioned on annular burner head 242 such that annular burner cap 246 covers annular burner head 242. Annular burner cap 246 may reduce staining of annular burner base 240 and/or annular burner head 242. For example, annular burner cap 246 may include an enamel coating on an outer surface 248 of annular burner cap 246, e.g., that faces away from annular burner head 242 and is visible to a user of burner assembly 200 when burner assembly 200 is positioned on top panel 142. The enamel coating on annular burner cap 246 may be easier to clean than and less stainable by spills from cooking utensils than the cast metal of annular burner base 240 and/or annular burner head 242.

As may be seen in FIGS. 4 and 5, gas burner assembly 200 also includes a temperature probe 250. Temperature probe 250 is mounted to fuel manifold 220. In addition, temperature probe 250 may be positioned at or adjacent an outer circumference (e.g., outer side wall 219) of annular burner body 210. For example, temperature probe 250 may be positioned radially outward of the outer circumference of annular burner body 210. In certain example embodiments, e.g., temperature probe 250 may be positioned within one inch of the outer circumference of annular burner body 210.

Temperature probe 250 may be spring loaded away from top surface 170 of top panel 142. Thus, a distal end 252 of temperature probe 250 may be normally positioned above annular burner body 210. When a cooking utensil is positioned on grates 152 above gas burner assembly 200, temperature probe 250 may retract, e.g., such that distal end 252 of temperature probe 250 is compressed against a bottom of the cooking utensil and/or flush with a top surface of grates 152.

Temperature probe 250 may include a jacket 254 and a bracket 256. Bracket 256 may be mounted to fuel manifold 220, e.g., below top panel 142. Jacket 254 may be mounted to bracket 256 such that jacket 254 may slide vertically on bracket 256. Jacket 254 may also extend through top panel 142 to distal end 152 of temperature probe 200. A spring 258 may be positioned with jacket 256, e.g., such that spring 258 is compressed between bracket 254 and jacket 256. Spring 258 may couple jacket 254 to bracket 256, e.g., such that spring 258 urges jacket 254 upwardly and/or away from bracket 256.

A lead 260 extends from a sensor, such as a thermistor or thermocouple, through jacket 256. Lead 260 may couple the sensor to a controller (not shown). The controller may receive a signal (e.g., a voltage or current) that corresponds to a temperature measurement via lead 260. When a cooking utensil is positioned on grates 152 above gas burner assembly 200 and temperature probe 250 contacts the cooking utensil, the signal from temperature sensor 200 may correspond to the temperature of the cooking utensil. Thus, temperature sensor 200 is configured for measuring the temperature of a cooking utensil above gas burner assembly 200.

Because temperature probe 250 is positioned at or adjacent the outer circumference of annular burner body 210 in the example embodiment shown in FIGS. 4 and 5, temperature probe 250 is located remote and/or is spaced from central combustion zone 212. Thus, flames within central combustion zone 212 do not impinge against temperature probe 250, and a performance (e.g., a temperature measurement resolution) of temperature probe 250 may be improved relative to gas burners with temperature probes within a central combustion zone. In addition, temperature probe 250 does negatively affect a flame or fuel flow pattern within central combustion zone 212.

Figure 6:
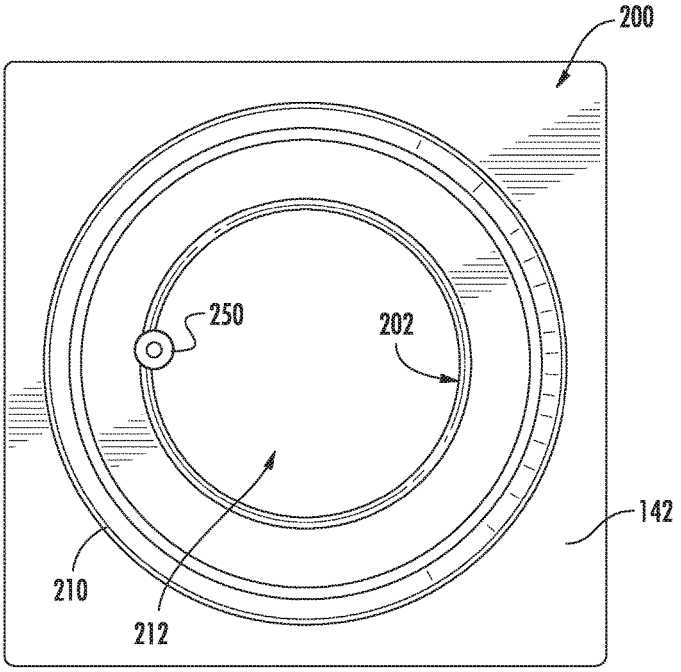
FIG. 6 is a perspective view of a gas burner assembly according to another example embodiment of the present subject matter.
Figure 7:
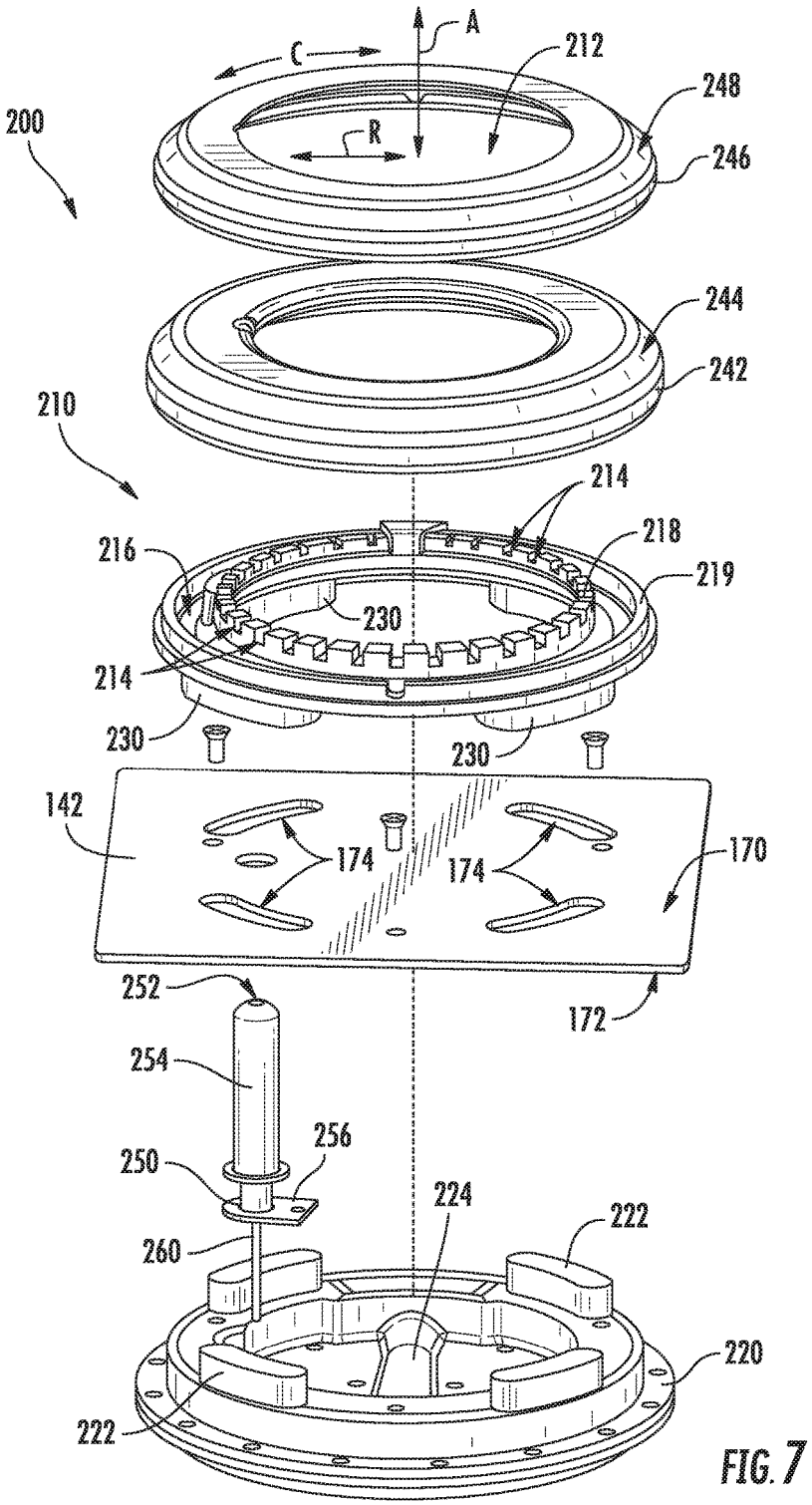
FIG. 7 is an exploded view of the example gas burner assembly of FIG. 6.
Figure 8:
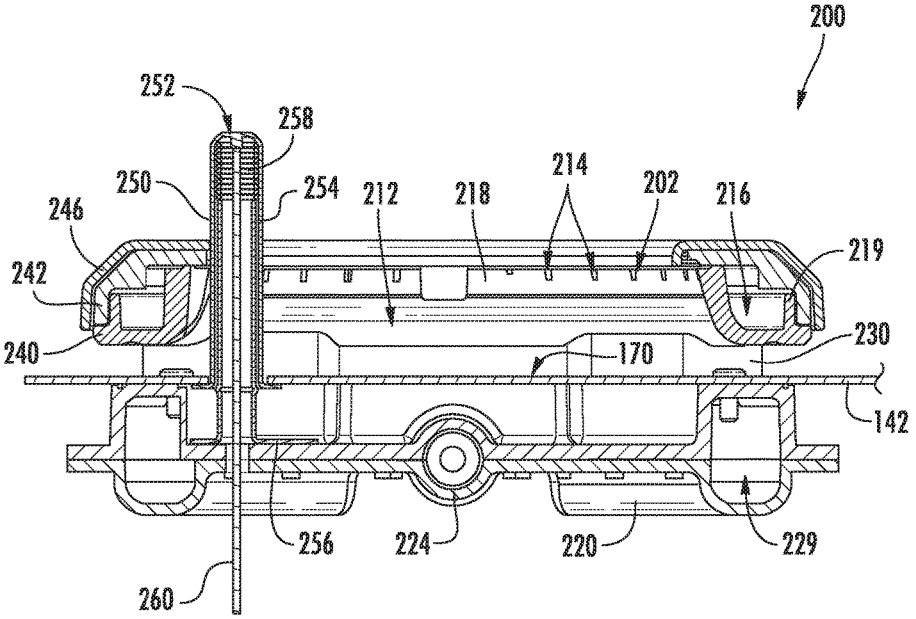
FIG. 8 is a section view of the example gas burner assembly of FIG. 6.

FIG. 6 is a perspective view of gas burner assembly 200 according to another example embodiment of the present subject matter. FIG. 7 is an exploded view of gas burner assembly 200 from FIG. 6, and FIG. 8 is a section view of gas burner assembly 200 from FIG. 6. The example gas burner assembly 200 shown in FIGS. 6 through 8 includes common component and operates in a similar manner to the example gas burner assembly 200 shown in FIGS. 6 through 8, e.g., except as otherwise noted. For example, the positon of temperature probe 250 is different between the example embodiment shown in FIGS. 3 through 5 and the example embodiment shown in FIGS. 6 through 8, as discussed in greater detail below.

As may be seen in FIGS. 6 through 8, temperature probe 250 may be positioned at or adjacent an inner circumference (e.g., inner side wall 218) of annular burner body 210. For example, temperature probe 250 may be positioned radially inward of the inner circumference of annular burner body 210. In certain example embodiments, e.g., temperature probe 250 may be positioned within one half inch of the inner circumference of annular burner body 210.

Because temperature probe 250 is positioned at or adjacent the inner circumference of annular burner body 210 in the example embodiment shown in FIGS. 6 through 8, temperature probe 250 is located at or within central combustion zone 212. To avoid flame impingement against temperature probe 250, flame ports 214 may be configured (e.g., positioned, oriented and/or sized) such that gaseous fuel from ports 214 does not impinge against temperature probe 250 when the gaseous fuel flows into central combustion zone 212 through flame ports 214. As an example, flame ports 214 that face temperature probe 250 may be smaller (e.g., have a smaller radial cross-section) than other flame ports 214 to restrict flames from such ports 214 impinging against temperature probe 250. As another example, ports 214 proximate temperature probe 250 may be oriented away from temperature probe 250. As yet another example, annular burner body 210 may have no ports 214 positioned adjacent (e.g., within one inch of) temperature probe 250. Thus, a performance (e.g., a temperature measurement resolution) of temperature probe 250 may be improved relative to gas burners with temperature probes with flame impingement. In addition, temperature probe 250 does not result in significant uneven heating above central combustion zone 212, e.g., because ports 214 fire radially inward and/or because ports 214 around temperature probe 250 can be sized and/or oriented to account for the space occupied by temperature probe 250.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

an inwardly firing gas burner assembly positioned at the top panel, the gas burner assembly comprising an annular burner body positioned on the top panel at a top surface of the top panel, the annular burner body defining a central combustion zone, the annular burner body also defining a plurality of flame ports at the central combustion zone, gaseous fuel flowable from a fuel chamber within the annular burner body into the central combustion zone through the plurality of flame ports; and a temperature probe positioned adjacent an outer circumference of the annular burner body such that the temperature probe is spaced from the central combustion zone, the temperature probe spring loaded away from the top surface of the top panel such that a distal end of the temperature probe is normally positioned above the annular burner body, wherein the temperature probe is positioned such that flames do not impinge against the temperature probe during combustion of the gaseous fuel at the plurality of flame ports, and wherein the annular burner body is open at the central combustion zone such that the top panel is exposed through the annular burner body at the central combustion zone, and the top panel is imperforate directly below the central combustion zone, wherein no portion of the annular burner body is positioned within the central combustion zone above the panel.

2. The cooktop appliance of claim 1, wherein the gas burner assembly further comprises a fuel manifold, the annular burner body connectable to the fuel manifold such that the gaseous fuel is flowable from the fuel manifold into the fuel chamber of the annular burner body, the fuel manifold having a plurality of outlet passages and a horizontal Venturi mixing tube, the gaseous fuel flowable through the plurality of outlet passages into the fuel chamber of the annular burner body, the horizontal Venturi mixing tube having an inlet positioned at one side portion of the fuel manifold and an outlet positioned at an opposite side portion of the fuel manifold.

3. The cooktop appliance of claim 2, wherein the fuel manifold is mounted to the top panel at a bottom surface of the top panel, the temperature probe mounted to the fuel manifold such that the temperature probe extends through the top panel.

4. The cooktop appliance of claim 3, wherein the plurality of outlet passages extend through the top panel towards the annular burner body, the plurality of outlet passages distributed about the central combustion zone.

5. The cooktop appliance of claim 4, wherein the fuel manifold defines an annular mixing Chamber, the plurality of outlet passages extending upwardly from the annular mixing chamber.

6. The cooktop appliance of claim 1, wherein the annular burner body is open at the central combustion zone such that the top panel is exposed through the annular burner body at the central combustion zone.

7. A cooktop appliance, comprising:

a top panel;

an inwardly firing gas burner assembly positioned at the top panel, the gas burner assembly comprising an annular burner body positioned on the top panel at a top surface of the top panel, the annular burner body defining a central combustion zone, the annular burner body also de-fining a plurality of flame ports at the central combustion zone, gaseous fuel flowable from a fuel chamber within the annular burner body into the central combustion zone through the plurality of flame ports; and a temperature probe positioned adjacent an inner circumference of the annular burner body, the temperature probe spring loaded away from the top surface of the top panel such that a distal end of the temperature probe is normally positioned above the annular burner body, wherein the plurality of flame ports is positioned and oriented such that flames do not impinge against the temperature probe during combustion of the gaseous fuel at the plurality of flame ports, and wherein the annular burner body is open at the central combustion zone such that the top panel is exposed through the annular burner body at the central combustion zone, and the top panel is imperforate directly below the central combustion zone, wherein no portion of the annular burner body is positioned within the central combustion zone above the top panel.

8. The cooktop appliance of claim 7, wherein the gas burner assembly further comprises a fuel manifold, the annular burner body connectable to the fuel manifold such that the gaseous fuel is flowable from the fuel manifold into the fuel chamber of the annular burner body, the fuel manifold having a plurality of outlet passages and a horizontal Venturi mixing tube, the gaseous fuel flowable through the plurality of outlet passages into the fuel chamber of the annular burner body, the horizontal Venturi mixing tube having an inlet positioned at one side portion of the fuel manifold and an outlet positioned at an opposite side portion of the fuel manifold.

9. The cooktop appliance of claim 8, wherein the fuel manifold is mounted to the top panel at a bottom surface of the top panel, the temperature probe mounted to the fuel manifold such that the temperature probe extends through the top panel.

10. The cooktop appliance of claim 9, wherein the plurality of outlet passages extend through the top panel towards the annular burner body, the plurality of outlet passages distributed about the central combustion zone.

11. The cooktop appliance of claim 10, wherein the fuel manifold defines an annular mixing chamber, the plurality of outlet passages extending upwardly from the annular mixing chamber.

* * * * *